United States Patent [19]

Gerke, Jr. et al.

[11] Patent Number: 4,942,641

[45] Date of Patent: Jul. 24, 1990

[54] ACCESSORY BRUSH ATTACHMENT

[75] Inventors: Burton E. Gerke, Jr., Newtown; Richard B. Kosten, West Haven, both of Conn.

[73] Assignee: Black & Decker Inc., Newark, Del.

[21] Appl. No.: 294,616

[22] Filed: Jan. 9, 1989

[51] Int. Cl.[5] ..... A47L 5/26

[52] U.S. Cl. ..... 15/338; 15/344; 15/377; 15/391

[58] Field of Search ..... 15/344, 338, 350, 351, 15/328, 377, 389, 391

[56] References Cited

U.S. PATENT DOCUMENTS

| | | | |
|---|---|---|---|
| 2,588,000 | 3/1952 | Hines | 15/414 X |
| 2,832,612 | 4/1958 | Coutts | 15/414 X |
| 3,039,129 | 6/1962 | Belicka et al. | 15/377 X |
| 4,209,875 | 7/1980 | Pugh et al. . | |
| 4,380,845 | 4/1983 | Miller et al. . | |
| 4,419,784 | 12/1983 | Lex . | |
| 4,513,470 | 4/1985 | Toya . | |
| 4,542,557 | 9/1985 | Levine . | |
| 4,573,234 | 3/1986 | Kochte et al. . | |
| 4,573,237 | 3/1986 | Kochte et al. . | |
| 4,610,048 | 9/1986 | Ishihara et al. . | |
| 4,642,841 | 2/1987 | Berfield et al. . | |
| 4,665,582 | 5/1987 | Richmond et al. . | |
| 4,704,765 | 11/1987 | Ataka . | |
| 4,747,178 | 5/1988 | Breitbach | 15/338 X |
| 4,766,638 | 8/1988 | McDowell | 15/414 X |
| 4,841,594 | 6/1989 | Elson et al. | 15/377 X |

FOREIGN PATENT DOCUMENTS

| | | |
|---|---|---|
| 1144716 | 4/1983 | Canada . |
| 1192359 | 8/1985 | Canada . |
| 1147360 | 4/1963 | Fed. Rep. of Germany . |
| 437676 | 11/1967 | Switzerland . |
| 2178949 | 2/1987 | United Kingdom . |

*Primary Examiner*—Chris K. Moore

*Attorney, Agent, or Firm*—B. E. Deutsch

[57] ABSTRACT

The present invention is an accessory brush attachment for a vacuum cleaner including an accessory motor and an accessory housing having a front end and a back end. The accessory housing encloses the accessory motor. The accessory housing has an intake aperture for reception of dirt, liquid and air drawn into the accessory housing in response to a vacuum produced by the vacuum cleaner. A rotatable brush is disposed within the intake aperture for contacting a surface to be cleaned. A means interconnects the brush and the accessory motor for allowing the accessory motor to rotate the brush. The housing includes first means for mounting the accessory brush attachment at a first point to the canister of the vacuum cleaner and a second means for mounting the accessory brush attachment at a second point to the vacuum cleaner housing.

9 Claims, 5 Drawing Sheets

ACCESSORY BRUSH ATTACHMENT

BACKGROUND OF THE INVENTION

1. Field of the Invention

The present invention relates generally to portable vacuum cleaners, more particularly to, a vacuum cleaner capable of operating with both air and liquid.

2. Description of Related Art

Currently, there exists portable vacuum cleaners which pick up or vacuum solid or liquid material. These portable vacuum cleaners are frequently referred to as "wet-dry" vacuum cleaners. Previously, an accessory brush attachment has been developed for use with the portable vacuum cleaner. This accessory brush attachment included a housing having a passageway formed through it in which one end fits over and about the free end of a canister of the vacuum cleaner. The accessory brush attachment also includes a brush mounted in a cavity at the other end of the passageway formed in the housing. The brush is operably connected by a drive belt to a motor disposed within the housing. The belt is accessible through a door on the housing. The door is opened with a conventional tool such as a slot-headed screw driver or the like.

To provide electrical power to the motor of the accessory brush attachment, a pair of contacts are disposed within the passageway of the housing and electrically connected to the motor. Correspondingly, the outer surface at the free end of the canister included a pair of contacts. When the free end of the canister is disposed in the passageway of the accessory brush attachment, the contacts touch each other to complete the electrical circuit and provide power to the accessory brush attachment.

It is, therefore, one object of the present invention to provide an accessory brush attachment for a wet-dry vacuum cleaner that may be used to clean carpets and other textured surfaces.

It is another object of the present invention to provide an accessory brush attachment that may be used for a cordless portable wet-dry vacuum cleaner.

It is a further object of the present invention to provide an accessory brush attachment which may be removed from the portable wet-dry vacuum cleaner.

It is a still further object of the present invention to provide an accessory brush attachment having a brush with dual bristles that can be used for both smooth and textured surfaces.

It is another object of the present invention to provide a wet-dry vacuum cleaner and accessory brush attachment which provides internal wiring for electrical connection between them.

It is a further object of the present invention to provide an accessory brush attachment having at least two mounting points for positive mounting of the attachment to the vacuum cleaner.

It is a still further object of the present invention to provide a belt cover door that is removable without the use of tools or the like.

SUMMARY OF THE INVENTION

Accordingly, the present invention is an accessory brush attachment for a vacuum cleaner including an accessory motor and an accessory housing having a front end and a back end. The accessory housing encloses the motor. The accessory housing has an intake aperture for reception of dirt, liquid and air drawn into the accessory housing in response to a vacuum produced by the vacuum cleaner. A rotatable brush is disposed within the intake aperture for contacting a surface to be cleaned. A means interconnects the brush and the accessory motor for allowing the accessory motor to rotate the brush. The accessory housing includes first means for mounting the accessory brush attachment at a first point to a canister of the vacuum cleaner and a second means for mounting the accessory brush attachment at a second point to a housing of the vacuum cleaner.

One advantage of the present invention is that the accessory brush attachment may be used with a cordless portable wet-dry vacuum cleaner. Another advantage of the present invention is that the accessory brush attachment may be removed from the wet-dry vacuum cleaner when not in use. A further advantage of the present invention is that the accessory brush attachment includes a brush having dual bristles that can be used for cleaning both smooth and textured surfaces. A still further advantage of the present invention is that the electrical wiring for the accessory brush attachment and vacuum cleaner is completely internal. Another advantage of the present invention is that the accessory brush attachment has two mounting points which provide positive mounting of the attachment to the vacuum cleaner. A further advantage of the present invention is that the belt cover door is removable without the use of tools or the like.

Other advantages of the present invention will be readily appreciated as the same becomes better understood by reference to the following detailed description when considered in connection with the accompanying drawings.

DESCRIPTION OF THE PREFERRED EMBODIMENT

Figure 3:
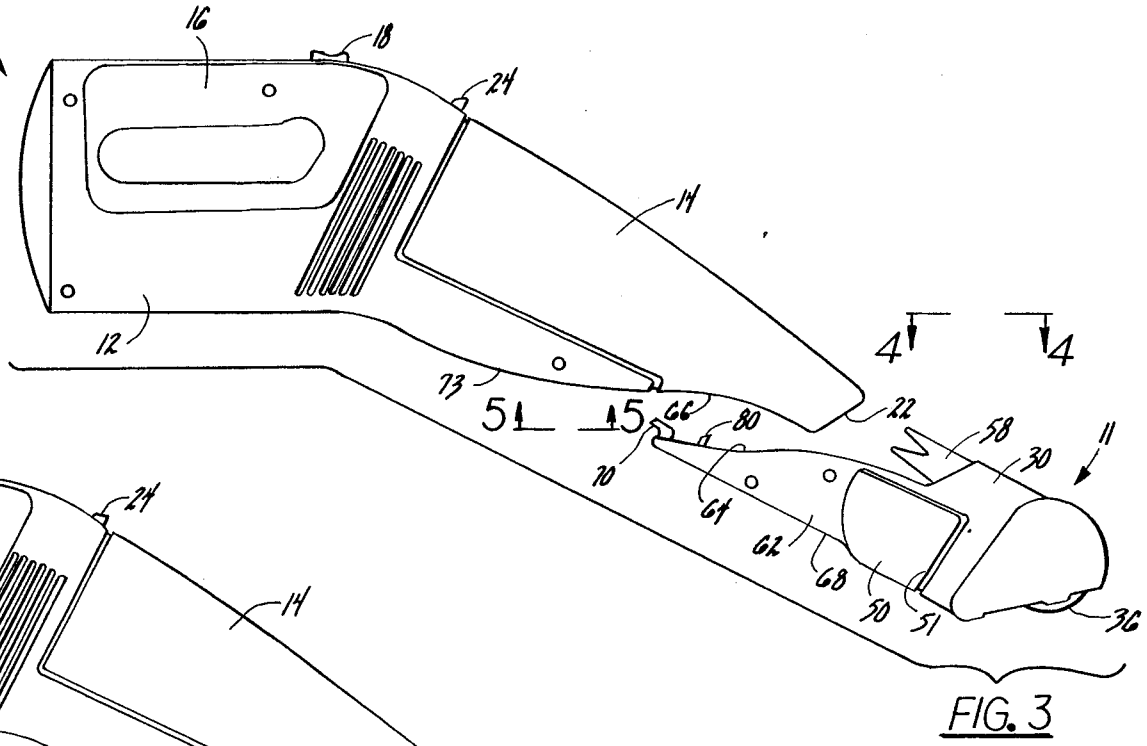
FIG. 3 is an exploded elevational view of the vacuum cleaner and accessory brush attachment of FIG. 2.
Figure 2:
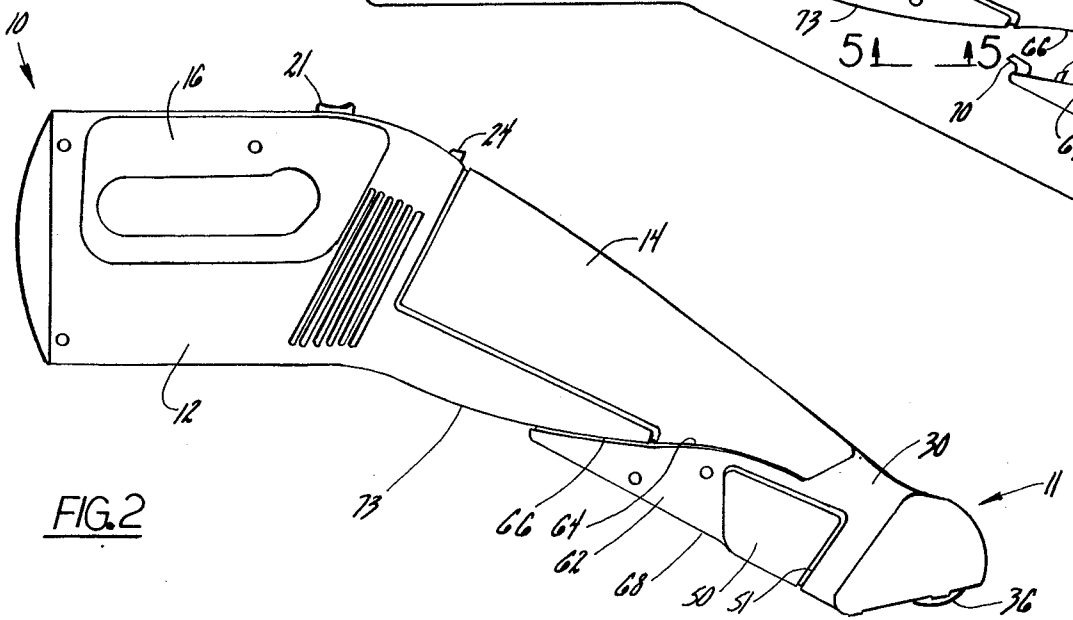
FIG. 2 is an elevational view of the vacuum cleaner of FIG. 1 and an accessory brush attachment incorporating the present invention in an assembled condition.

Referring to FIGS. 2 and 3, a vacuum cleaner 10 and accessory brush attachment 11 according to the present invention are shown. The vacuum cleaner 10 comprises a central housing 12 having a canister 14 affixed to a front end thereof and a handle 16 formed near the back end thereof. The handle 16 is configured to be grasped by the hand of a person using the vacuum cleaner 10 for the cleaning of upholstery, rugs, as well as in the dusting of flat surfaces such as the top of a table.

Figure 1:
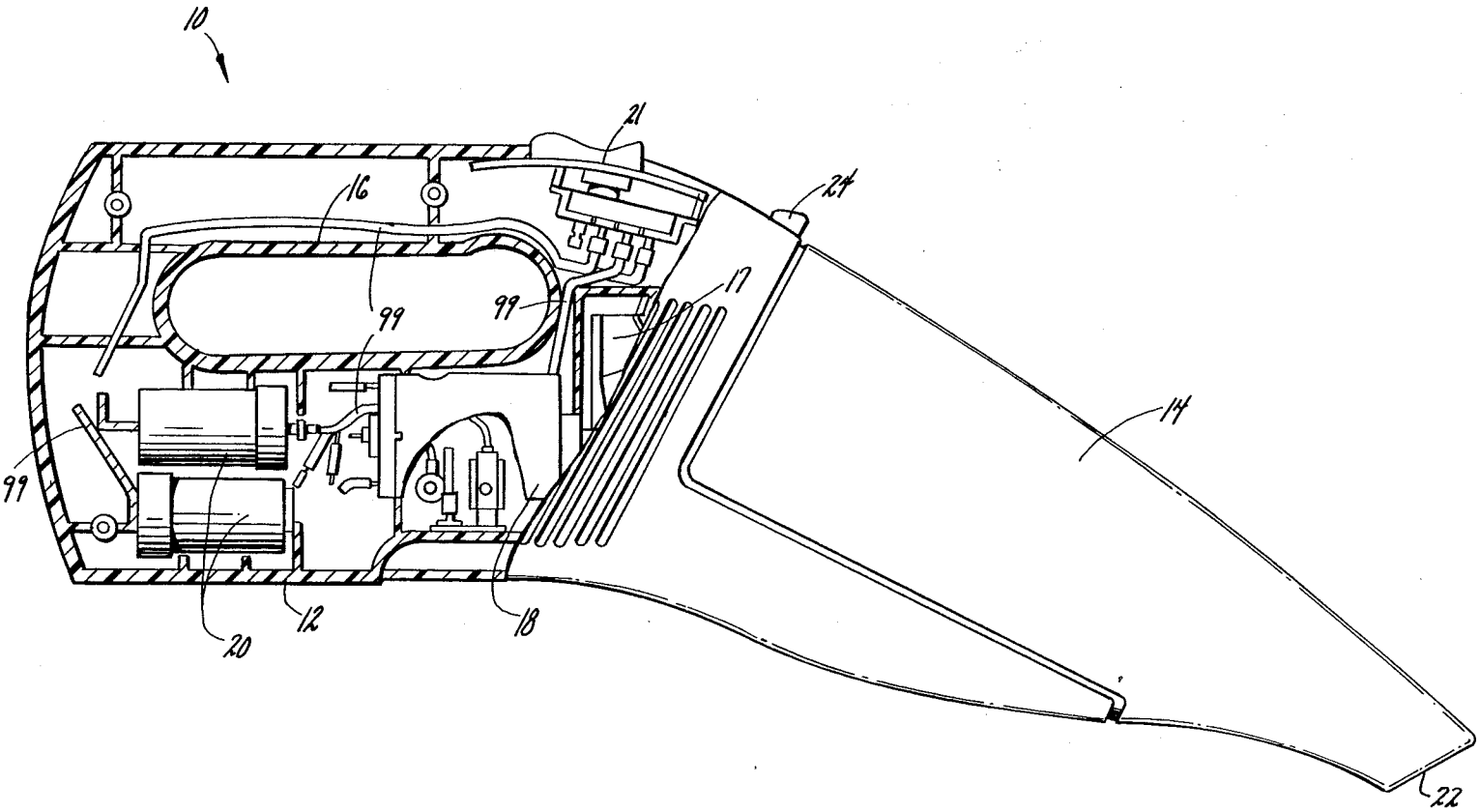
FIG. 1 is an elevational view with a portion broken away of a vacuum cleaner according to the present invention.

Referring to FIG. 1, the housing 12 contains a source of suction or fan 17 which may also be referred to as a blower or impeller, and an electric motor 18 coupled by a shaft 19 to the fan 17. Rotation of the shaft 19 by the motor 18 imparts rotation to the fan 17 to create a partial vacuum and the accompanying suction which draws air and foreign matter into the canister 14. The motor 18 is powered by batteries 20. A switch 21 is positioned on the upperside of the handle 16 for convenient engagement by means of the thumb of a person utilizing the vacuum cleaner 10. Operation of the switch 21 provides for the coupling of electric power from the batteries 20 to the motor 18 for activation of the motor 18. Electric wiring 99 connects the batteries 20 via the switch 21 to the motor.

Figure 6:
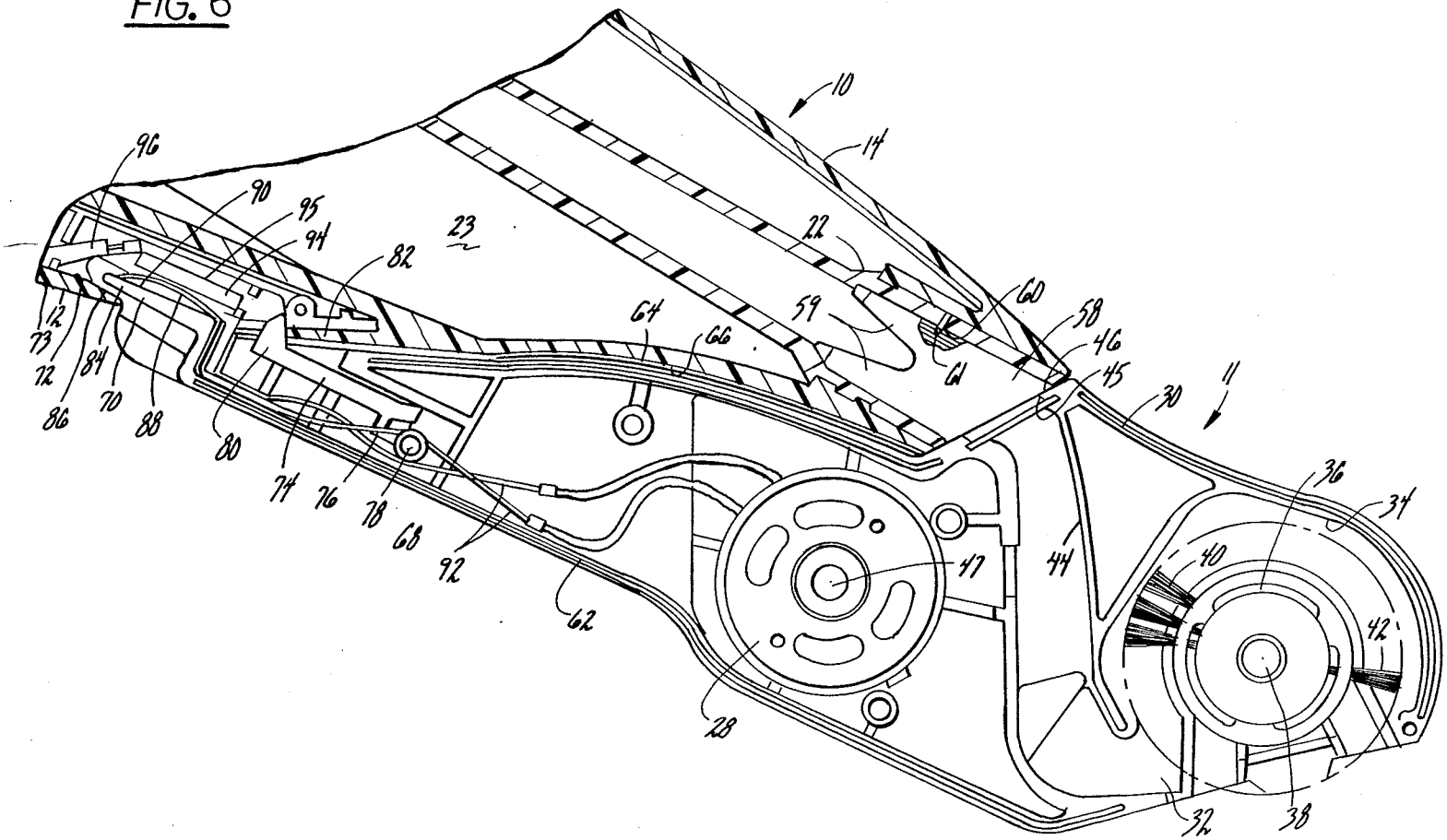
FIG. 6 is a partial sectional view of the vacuum cleaner and accessory brush attachment of FIG. 2.

Referring to FIG. 6, the canister 14 incorporates a nozzle 22 and a storage chamber 23. The storage chamber 23 will be used for the collection of any liquid and/or dirt which may be drawn by suction or vacuum into the canister 14 of the vacuum cleaner 10. The canister 14 is removably attached to the forward end of the housing 12 by means of a latch member 24 or the like as illustrated in FIG. 2.

Figure 4:
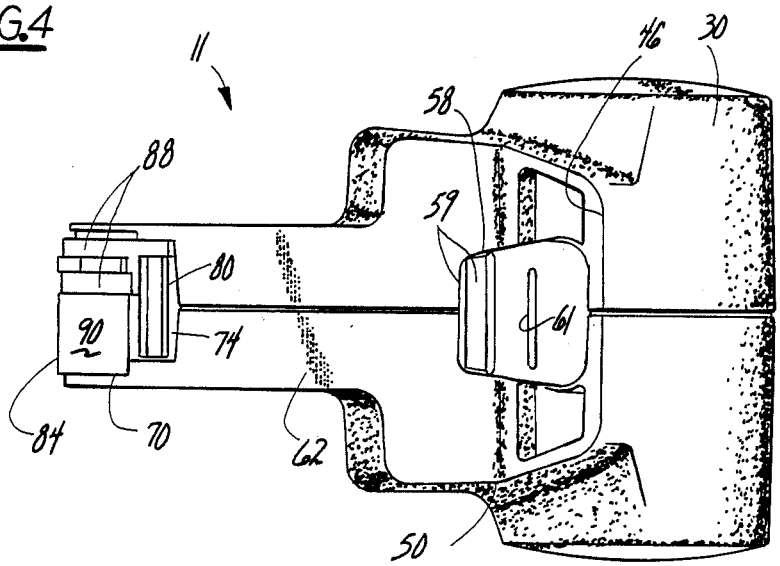
FIG. 4 is a sectional view of the accessory brush attachment taken along line 4—4 of FIG. 3.

Referring to FIGS. 4 and 6, the accessory or power brush attachment 11 for use with the vacuum cleaner 10 is shown. The accessory brush attachment 11 includes an accessory motor 28 and an accessory housing 30 enclosing the accessory motor 28. The forward end of the accessory housing 30 includes an intake aperture 32 and a brush cavity 34 formed therein. A brush 36 is rotatably mounted within the brush cavity 34. The brush 36 generally comprises a cylindrical shaft 38 having at least one row of bristles 40 extending radially outwardly from the shaft 38. Preferably, the brush 36 has at least a pair of rows of bristles 40 and 42. The bristles 40 and 42 may be made from different materials. The bristles 40 are made for use on smooth surfaces and the bristles 42 are made for use on textured surfaces. The ends of the shaft 38 are journally supported by bearings secured to the sidewalls of the brush cavity 34.

The accessory brush attachment 11 also includes a passageway 44 formed within the accessory housing 30 which fluidly communicates with the intake aperture 32 and an exit aperture 45 at a rearward face 46 of the accessory housing 30. Air flow caused by the vacuum produced by the blower of the vacuum cleaner 10 travels from the intake aperture 32, through the passageway 44, and out the exit aperture 45 to the nozzle 22 and into the canister 14 of the vacuum cleaner 10.

Figure 7:
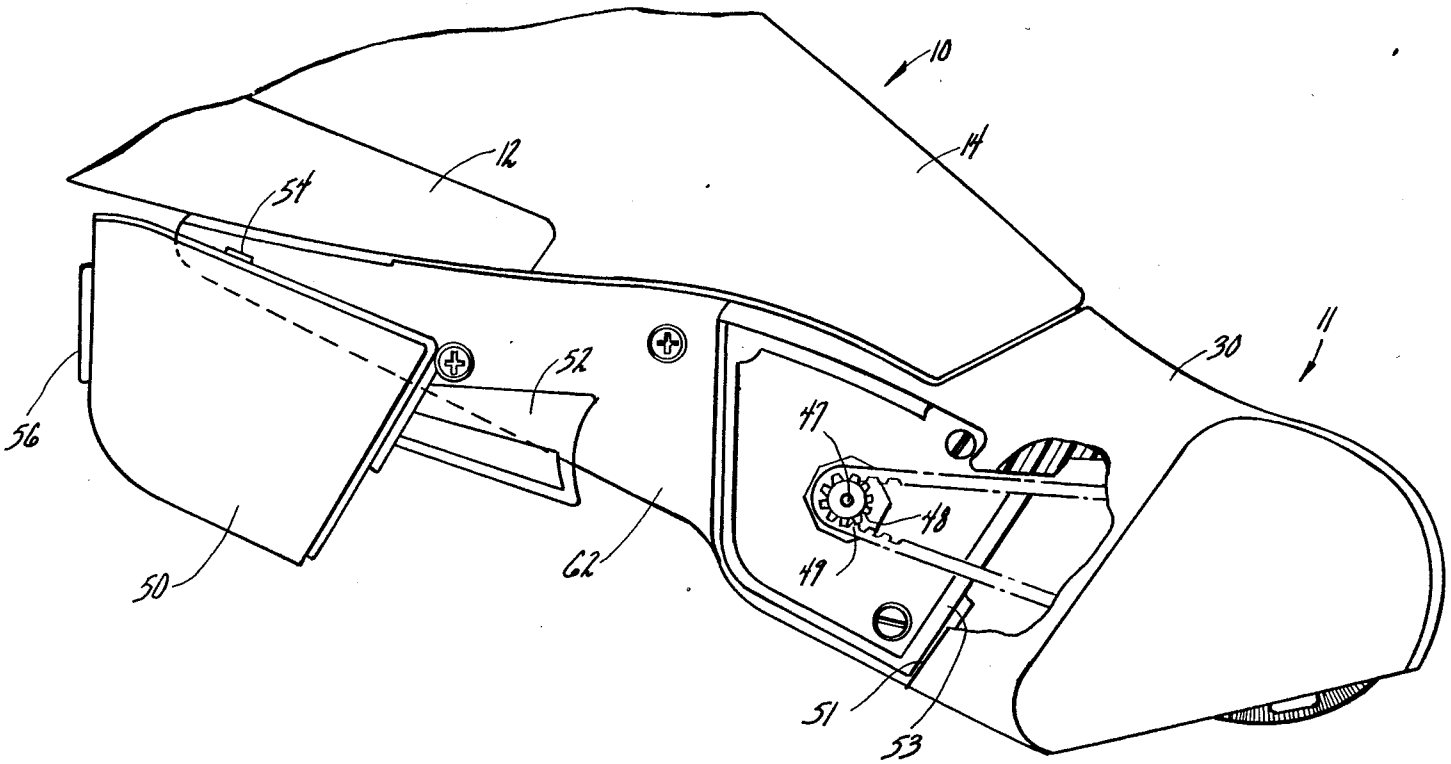
FIG. 7 is a partial exploded view of an access door for the accessory brush attachment of FIGS. 2 and 3.

Referring to FIG. 7, the accessory brush attachment 11 further includes a cylindrical gear (not shown) disposed about and secured to the shaft 38 of the brush 36. The accessory motor 28 also includes a rotatable shaft 47 having a gear 48 at one end which is aligned spatially with the gear of the shaft 38 for the brush 36. A toothed belt 49 is disposed about the gears to interconnect the accessory motor 28 and brush 36 such that the rotation of the shaft 47 of the accessory motor 28 will cause the shaft 38 of the brush 36 to correspondingly rotate, in turn, rotating the brush 36.

The accessory housing 30 also includes an access door 50 slideably disposed in a door cavity 51 formed in the accessory housing 30 to allow access to the belt 49. The access door 50 includes an end portion 52 extending axially from one end of the access door 50. The end portion 52 is slideably disposed in an aperture 53 formed in the housing 30 at one end of the door cavity 51. The access door 50 also has a tab 54 extending upwardly from an upper surface thereof. The tab 54 "snaps" or is disposed in a corresponding tab aperture 55 formed in the upper wall of the door cavity 51 to secure the access door 50 in position within the door cavity 51. The access door 50 also includes a projecting member 56 along the rearward end to allow an operator to grasp the member 56 to move the access door 50 into and out of engagement with the door cavity 51.

Referring again to FIGS. 4 and 6, the accessory brush attachment 11 also includes a first mounting member 58 at the rearward face 46 of the housing 30. The first mounting member 58 extends axially outwardly from the rearward face 46 of the accessory housing 30 at the exit aperture 45 of the passageway 44. The first mounting member 58 has a generally "V" shaped side profile formed by a pair of finger members 59. An aperture or passageway is formed within the first mounting member 58 and fluidly connects the exit aperture 45 to the nozzle 22 of the vacuum cleaner 10.

As illustrated in FIGS. 2 and 3, the first mounting member 58 is removably disposed within the nozzle 22 of the canister 14. The first mounting member 58 is made of a plastic material that permits the finger members 59 to have some degree of flexibility to allow some deflection toward each other and resiliency to return the finger members 59 to their original undeflected position as shown in FIG. 6. The first mounting member 58 is positively located within the nozzle 22 of the vacuum cleaner 10 by a snap ring 60 which engages a corresponding groove 61 in uppermost of the fingers 59.

The accessory housing 30 includes a rearwardly and axially extending extension portion 62. The extension portion 62 has a generally arcuate top or upper surface 64 which mates with a corresponding generally arcuate bottom surface 66 of the canister 14. In other words, the upper surface 64 and bottom surface 66 have a shape which is generally arcuate and complimentary to each other. The extension portion 62 also has a bottom surface 68.

The accessory brush attachment 11 also includes a second mounting member 70 at the rearward end of extension portion 62 and extending axially and rearwardly from the extension portion 62. The second mounting member 70 is generally rectangular in shape. The second mounting member 70 is slideably and removably disposed in correspondingly rectangular mounting cavity 72 formed in a bottom surface 73 of the vacuum cleaner housing 12. A latch member 74 is pivotally connected at one end to a spring 76 disposed about a shaft 78 secured within the accessory housing 30. The latch member 74 has a generally "V" shaped protrusion 80 upwardly extending at the free end thereof. The protrusion 80 engages a flange 82 extending axially and downwardly from the bottom surface 66 of the canister 14 to secure the canister 14 to the accessory brush attachment 11. The latch member 74 has first undeflected position such that the protrusion 80 engages the end of the flange 82 to prevent axial movement or separation between the canister 14 and the accessory brush attachment 11. It should also be appreciated that the protrusion 80 may engage a shoulder or wall of the mounting cavity 72 in the first undeflected position.

The latch member 74 also has a second deflected position in which the protrusion 80 disengages the end of the flange 82 to permit removal or separation of the accessory brush attachment 11 from the canister 14. The spring 76 biases the latch member 74 in the undeflected or first position. The second mounting member 70 also has a lip 84 which rests or is supported by an end wall 86 of the vacuum cleaner housing 12 forming the mounting cavity 72. The lip 84 and second mounting member 70 provide a second positive mounting point for the accessory brush attachment 11.

Figure 5:
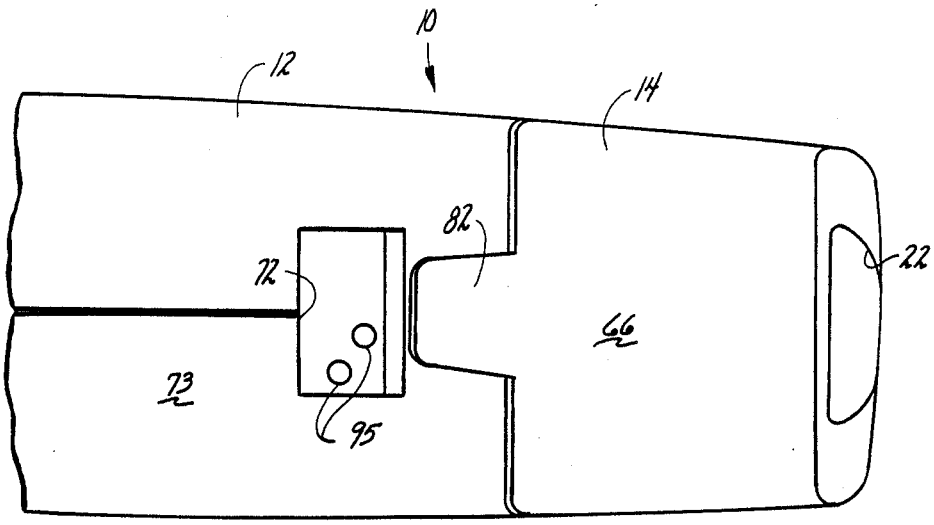
FIG. 5 is a sectional view of the accessory brush attachment taken along line 5—5 of FIG. 3.

The second mounting member 70 includes a pair of laterally spaced contact strips 88 on the upper surface 90 thereof. The contact strips 88 are metallic and flexible. The contact strips 88 are connected by electrical wiring 92 to the accessory motor 28. The vacuum cleaner 10 also includes a terminal block 94 secured to the vacuum cleaner housing 12 inside the mounting cavity 72. As illustrated in FIGS. 5 and 6, the terminal block 94 includes a pair of contacts 95 which are connected by electrical wiring 96 to the switch 21 and batteries 20. When the second mounting member 70 is disposed in the mounting cavity 72, the contact strips 88 contact or touch the contacts 95 and are electrically connected to the switch 21 and batteries 20 of the vacuum cleaner 10 to allow electrical power to flow to the accessory motor 28 upon actuating the switch 21.

The present invention has been described in an illustrative manner. It is to be understood that the terminology which has been used is intended to be in the nature of words of description rather than of limitation.

Obviously, many modifications or variations of the present invention are possible in light of the above teachings. Therefore, within the scope of the appended claims, the present invention may be practiced otherwise than as specifically described.

What is claimed is:

1. An accessory brush attachment for a vacuum cleaner comprising:

a motor;

a housing having a front end and a back end, said housing enclosing said motor;

said housing having an intake aperture for reception of dirt, liquid and air drawn into said housing in response to a vacuum produced by the vacuum cleaner;

a rotatable brush disposed within said intake aperture for contacting a surface to be vacuumed;

means interconnecting said brush and said motor for allowing said motor to rotate said brush;

said housing including first means for mounting said accessory brush attachment at a first point to a canister of the vacuum cleaner, said first means comprising a tubular member removably disposed in the end of a nozzle of the canister of the vacuum cleaner; and said housing including second means for mounted said accessory brush attachment at a second point to a housing of the vacuum cleaner.

2. An accessory brush attachment as set forth in claim 1 wherein said second means comprises a mounted member removably disposed in a cavity formed in the bottom of the housing of the vacuum cleaner.

3. An accessory brush attachment as set forth in claim 2 wherein said mounting member includes a pair of contacts electrically connected to said motor for engaging a corresponding pair of contacts in the cavity of the housing of the vacuum cleaner to provide electrical power from the vacuum cleaner to said accessory brush attachment.

4. An accessory brush attachment as set forth in claim 3 wherein said brush includes at least two types of bristles for cleaning smooth and textured surfaces.

5. A brush attachment as set forth in claim 4 wherein said housing includes an access door slideably disposed in a cavity formed in said housing to allow access to said connecting means.

6. A vacuum cleaner and accessory attachment assembly comprising:

a vacuum cleaner including a fan motor, a housing enclosing said fan motor, a fan driven by said fan motor for producing a vacuum, a canister removably attached to said housing for reception of said and foreign matter into said canister in response to the vacuum produced by said fan, a power source for supplying power to said motor;

an accessory brush attachment removably mounted to said vacuum cleaner and including an accessory motor, means for electrically connecting said accessory motor to said power source of said vacuum cleaner, an accessory housing having a front end and a back end, said accessory housing enclosing said accessory motor;

said accessory housing having an intake aperture for reception of dirt, liquid and air drawn into said accessory housing in response to a vacuum produced by said vacuum cleaner;

a rotatable brush disposed within said intake aperture for contacting a surface to be vacuumed;

means interconnecting said brush and said accessory motor for allowing said accessory motor to rotate said brush;

said accessory housing including first means for mounting said accessory brush attachment at a first point to said canister of the vacuum cleaner, said first means comprising a tubular member removably disposed in the end of said nozzle of said canister of said vacuum cleaner; and said accessory housing including second means for mounting said accessory brush attachment at a second point to said housing of said vacuum cleaner.

7. An accessory brush attachment as set forth in claim 6 wherein said second means comprises a mounting member removably disposed in a mounting cavity formed in the bottom of said housing of the vacuum cleaner.

8. An accessory brush attachment as set forth in claim 7 wherein said mounting member includes a first pair of contacts electrically connected to said accessory motor, said vacuum cleaner having a second pair of contacts disposed within the mounting cavity and electrically connected to said power source, said first pair of contacts engaging said second pair of contacts when said mounting member is disposed in said mounting cavity of said housing of said vacuum cleaner to provide electrical power from said power source of said vacuum cleaner to said accessory brush attachment.

9. A vacuum cleaner and accessory attachment assembly comprising:

a vacuum cleaner including a fan motor, a housing enclosing said fan motor, a fan driven by said fan motor for producing a vacuum, a canister removably attached to said housing for reception of air and foreign matter into said canister in response to the vacuum produced by said fan, a power source for supplying power to said motor;

an accessory brush attachment removably mounted to said vacuum cleaner and including an accessory motor, means for electrically connecting said accessory motor to said power source of said vacuum cleaner, an accessory housing having a front end and a back end, said accessory housing enclosing said accessory motor;

said accessory housing having an intake aperture for reception of dirt, liquid and air drawn into said accessory housing in response to a vacuum produced by said vacuum cleaner;

a rotatable brush disposed within said intake aperture for contacting a surface to be vacuumed;

means interconnecting said brush and said accessory motor for allowing said accessory motor to rotate said brush;

said accessory housing including first means for mounted said accessory brush attachment at a first point to said canister of the vacuum cleaner;

said accessory housing including second means for mounting said accessory brush attachment at a second point to said housing a said vacuum cleaner;

said first means comprises a tubular member removably disposed in the end of said nozzle of said canister of said vacuum cleaner;

said second means comprises a mounting member removably disposed in a mounting cavity formed in the bottom of said housing a of the vacuum cleaner;

said mounting member includes a first pair of contacts electrically to said accessory motor, said vacuum cleaner having a second pair of contacts disposed within the mounting cavity and electrically connected to said power source, said first pair of contacts engaging said second pair of contacts when said mounting member is disposed in said mounting cavity of said housing of said vacuum cleaner to provide electrical power from said power source of said vacuum cleaner to said accessory brush attachment;

said brush includes at least two types of bristles for cleaning smooth and textured surfaces; and said housing includes an access door slideably disposed in a cavity formed in said housing to allow access to said connecting means.

* * * * *